United States Patent [19]

Mayr et al.

[11] Patent Number: 4,928,989

[45] Date of Patent: May 29, 1990

[54] SKI HAVING A CORE COMPRISING ANGLED PROFILES

[75] Inventors: Bernhard Mayr, Hard; Heinz Lampl, Hohenems, both of Austria

[73] Assignee: Head Sportgeraete Gesellschaft m.b.H. & Co. OHG, Kennelbach, Austria

[21] Appl. No.: 279,682

[22] Filed: Dec. 5, 1988

[30] Foreign Application Priority Data

Dec. 9, 1987 [AT] Austria ..... 3239/87

[51] Int. Cl.[5] ..... A63C 5/12

[52] U.S. Cl. ..... 280/610

[58] Field of Search ..... 280/610, 601, 602; 428/184

[56] References Cited

U.S. PATENT DOCUMENTS

| | | | |
|---|---|---|---|
| 3,698,731 | 10/1972 | Jost et al. | 280/610 |
| 3,861,699 | 1/1975 | Molnar | 280/610 |

FOREIGN PATENT DOCUMENTS

| | | | |
|---|---|---|---|
| 309282 | 8/1973 | Austria . | |
| 734828 | 5/1966 | Canada | 280/610 |
| 2119862 | 1/1973 | Fed. Rep. of Germany | 280/610 |
| 2332909 | 1/1974 | Fed. Rep. of Germany . | |
| 2526108 | 1/1976 | Fed. Rep. of Germany | 280/610 |
| 3712030 | 12/1987 | Fed. Rep. of Germany | 280/610 |
| 1380663 | 10/1964 | France | 280/610 |

*Primary Examiner*—Charles A. Marmor
*Assistant Examiner*—Michael Mar
*Attorney, Agent, or Firm*—Finnegan, Henderson, Farabow, Garrett & Dunner

[57] ABSTRACT

A ski comprises a running surface, a top surface and side surfaces extending between the running surface and the top surface. A core is defined by the running surface, the top surface and the side surfaces. Angled profiles are formed inside the core. Each angled profile includes a base and two legs extending from the longitudinal ends of the base. At least two of the angled profiles are at least partially enclosed in each other in overlapping relationship such that the height of one of the inner legs of each of the overlapping angled profiles is decreased by an amount corresponding to the height of the base.

10 Claims, 1 Drawing Sheet

SKI HAVING A CORE COMPRISING ANGLED PROFILES

BACKGROUND OF THE INVENTION

1. Field of the Invention

The invention refers to a ski comprising a core defined by running surface, a top surface, and side surfaces in which the core consists at least partially of angled profiles.

2. Description of the Prior Art

In the production of skis it is known to provide cores composed of essentially profile ledges arranged sideways. It is further known to give such ledges an essentially parallelogram-shaped cross-section and to connect such ledges, which are arranged in an inclined position, to form a core when they are located one beside the other. In this connection, several complicated measures have been proposed for the purpose of achieving the desired elastic properties and strength characteristics, and it is known to combine one with the other, with the resulting ledges consisting of different materials for meeting the requirements with respect to elasticity as well as with respect to strength.

In the production of skis, it is further known to form cores at least partially of angled profiles comprising areas extending in parallel relation to the running surface and comprising legs extending essentially in normal relation to said areas and consisting of fiber-reinforced synthetic plastics material. Cavities formed between adjacent legs are filled with a filling material. The shape of the ski core is cut out of the shaped body formed by such a filled profile. It is a drawback of such an arrangement that on occasion of cutting out the ski shape, side surfaces or, respectively, surface areas are formed consisting of filling material and having strength characteristics and elastic properties which do not sufficiently meet the requirements.

As disclosed in Austrian Patentschrift No. AT-PS 309 282 a hollow ski of synthetic plastics material and comprising a top plate member and a bottom plate is known. Each number comprises webs extending in the longitudinal direction of the ski and laterally staggered in lateral direction. The plate members are glued at the flanks of their webs in a groove-and-tongue joint for forming the ski. In German Offenlegurgsschrift DE-OS 23 32 909, there is disclosed a hollow ski, in which a cover plate provided with legs is connected with a second core portion provided with leg portions for the purpose of forming side surfaces. The leg portions are reinforced by glass fibers at the core portions. After uniting both core portions, there results as a ski having a rule a chest-like hollow construction. It is a drawback of this known construction that the used core portions must exactly be coordinated one relative to the other with respect to their size. Any adaptation to the required strength characteristics and elastic properties can only be achieved by varying the dimensions of the core portions or intrinsic properties, so that a great number of different molds for core portions must be produced for different ski properties as well as for different ski sizes.

SUMMARY OF THE INVENTION

The invention now aims at providing a core construction of particularly low weight and achieving, in spite of the low weight, a high strength and good elastic properties. The invention furthermore aims at providing such a construction which, in spite of being a lightweight construction, provides the possibility to adapt the properties of flexibility and, elasticity In any case the required strength characteristics, in particular the required torsion rigidity are fulfilled. For solving this task, the invention essentially consists in that the core has two at least profiles extending in longitudinal direction, in that the angled profiles are at least partially enclosed in each other in overlapping manner Each profile includes legs which extend in essentially normal relation to the running surface. The leg located adjacent the center of the ski is shortened by an amount corresponding to the wall thickness of the profile. On account of the shortened design of the respective by being located adjacent the center of the ski and extending essentially in normal relation to the running surface, the torsion chest formed by the profiles at least partially enclosed in each other other has a constant height over its whole width. Because the respective webs located adjacent the center of the ski and extending in essentially normal relation to the running surface are each engaged in a cavity being defined by two legs, it becomes possible to vary the width of the ski within certain limits by correspondingly positioning such a leg within the adjoining cavity of the adjacent profile. By suitably dimensioning and designing the profile, the ski may be formed of two symmetrically shaped profiles, which can, when assembling the ski, be connected one with the other, in a mutually staggered manner to form a torsion chest either by rotating within a plane around 180° or by rotating for 180° around the axis extending in longitudinal direction of the ski.

According to another embodiment of the invention, at least three angled profiles may be at least partially enclosed in one another and overlap. The three angled profiles include a central profile and two outer profiles the central profile defines between essentially vertical legs an odd number of cavities. Either the respective outer legs of the central profile is shorter than the profile height of the adjacent profiles and that the outer profiles have correspondingly shorter legs at the location where the central profile contacts the inner legs of the outer profile. The amount of such shortening corresponds to the wall thickness of the adjacent profile. With three profiles, a standardized central profile can be used, whereas the outer profiles are designed in correspondence with the dimensions of the ski to be manufactured. In such a construction it is possible to realize the requirements with respect to flexibility characteristics and elastic properties by giving the individual core portions differing profile shapes. For the purpose of achieving a constant height over the whole cross section, the legs are given, in correspondence with the wall thickness of the profile, a shorter height in the overlapping areas. When the central core portion has an odd number of cavities, one single profile can be used as the outer core portion, which is, when manufacturing the ski, used staggered for 180° either in the plane of the ski or around an axis staggered in longitudinal direction of the ski. Of course, the central core portion may also enclose an even number of cavities, noting that in such a case, when forming a ski comprising lateral edges extending in essentially normal relation to the running surface, one single type of profile can again be used for forming both outer core portions, which must, in the above described manner, be staggered one relative to the other. If, however, outer legs of the lateral core portions are, in correspondence with the angle of the lateral edges, angled out of the essentially vertical position, as in the preferred embodiment of the invention, two different outer profiles must be used when using a central core portion comprising an even number of cavities.

On account of such an arrangement of the angled profiles being partially enclosed one in the other in a mutually overlapping manner, the bending stiffness and, respectively, torsion rigidity can be substantially improved in a lightweight construction and there result in this manner mutually enclosed torsion chest constructions. When the profiles are made of fiber-reinforced synthetic plastics material or of aluminium, simple and inexpensive profiles can be used, the material characteristics of which may, within broad limits, be adapted to the required flexibility characteristics and, elastic properties differing widths of the ski may be obtained with substantially similarly constructed parts and that different elastic properties and strength characteristics can be realized by means of parts constructed of standard shape on account of the amount of overlapping.

In a particularly simple manner, the procedure is preferably such that the central core portion has a substantially U-shape and that the legs of the U-shaped part have a shorter height than the profile height of the adjacent profiles. The necessary requirements may be taken into consideration by suitably positioning the outer core portions within the central core portion.

The material used the fiber-reinforced synthetic plastics material is the usual synthetic plastics materials reinforced by glass fibers or carbon fibers. The properties of the materials may be adjusted within broad limits by the selection of the reinforcing fibers.

For shorter skis or children's skis, non-reinforced synthetic plastics materials can also be used, for example thermoplastic or duroplastic materials, or aluminum profiles having variable wall thicknesses for adjusting the stiffness.

BRIEF DESCRIPTION OF THE DRAWINGS

In the following, the invention is further explained with reference to embodiments schematically shown in the drawing.

DETAILED DESCRIPTION OF PREFERRED EMBODIMENTS

Figure 1:
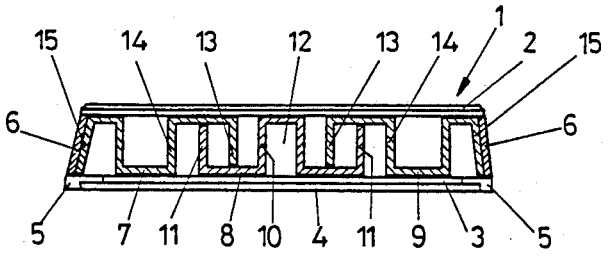
FIG. 1 shows a cross-section of a ski according to the invention.

The ski 1 shown in FIG. 1 has a top strap 2, a bottom strap 3 and a running surface 4, which is flush with edges 5. Side surfaces 6 extend between the top strap 2 and the bottom strap 3 or, respectively, the running surface 4 and include with the running surface 4 an angle deviating from a normal line, as is shown in FIG. 1. Of course, the side surfaces 6 may extend normally to the running surface 4. The ski core extending between the top strap 2 and the bottom strap 3 is formed of angled profiles 7, 8, 9 which are partially enclosed within one another and overlap. In this case, the central profile 8 defines between its substantially vertical legs 10 and 11 an odd number of cavities 12. The respective outwardly located vertical legs 11 the central core portion 8 are of shorter in height than the profile height of the adjacent legs 10, so that there results, when assembling the central core portion with the outer profiles 7 and 9, a constant height over the whole cross section. The respective outwardly located cavities 12 of the central core portion 8 are engaged by substantially vertical legs 13 of the outer core portions 7 and 9, which are again shorter in height than the adjacent legs 14. The legs 15 located adjacent the side surfaces 6 are disposed at an angle deviating from the normal direction of the running surface 4. By adjusting the degree of mutual overlapping of the individual profiles, i.e. by selecting the distance between the webs 11 of the central core portion 8 and the lges 13 of the outer profiles 7 and 9, the width of the ski may be varied within broad limits and adjusted in correspondence with the requirements.

Figure 2:
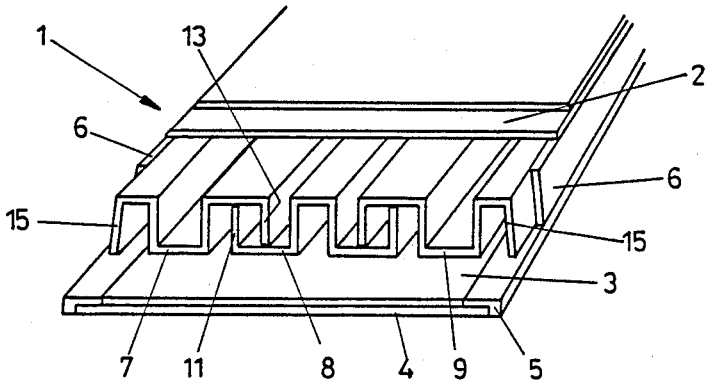
FIG. 2 shows a perspective view of the ski according to FIG. 1.

In the perspective representation according to FIG. 2, the reference numerals of FIG. 1 have been maintained. From FIG. 2 can be seen the partially enclosed and overlapping arrangement of the profiles 7, 8 and 9.

Figure 3:
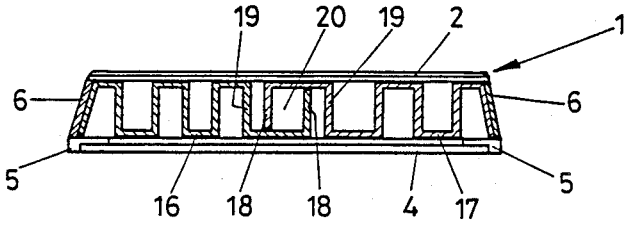
FIG. 3 shows a modified embodiment of a ski according to the invention.

In the representation according to FIG. 3, the ski core is formed of two profiled parts 16 and 17 extending in longitudinal direction. The leg 18 located adjacent the center of the ski and extending in essentially normal direction is shorter in height as compared with the other leg 19. The height reduction corresponds to the wall thickness of the profile for obtaining a constant height over the whole cross section. Also in this embodiment, the width of the whole ski can be varied by correspondingly arranging the respective legs 18 located adjacent the center of the ski within the corresponding cavity 20 of the other profiled part.

In all embodiments, the elastic properties and the strength characteristics may easily be adapted to the existing requirements by suitably selecting the distance between respective adjacent legs extending in the substantially normal direction to the longitudinal direction of the ski of the respective profiled parts.

Additional advantages and modifications will readily occur to those skilled in the art. The invention in its broader aspects is, therefore, not limited to the specific details, representative apparatus and illustrative examples shown and described. Accordingly departures may be made from such details without departing from the spirit or scope of the general inventive concept as defined by the appended claims and their equivalents.

What is claimed is:

1. A ski comprising:

a running surface extending in a longitudinal direction;

a top surface extending parallel to and spaced from the running surface;

a plurality of side surfaces extending between the running surface and the top surface;

a core defined by the running surface, the top surface and the side surfaces;

a plurality of angled profiles formed inside the core, each angled profile comprising a plurality of longitudinally extending and laterally spaced bases extending substantially parallel to the running surface, said bases including upper base portions adjacent said top surface and lower base portions adjacent said running surface, said upper and lower base portions having longitudinally extending side edges a plurality of inner legs, and a plurality of outer legs adjacent the side surfaces, each of the inner legs extending from the longitudinal side edges of the respective base upper and lower portions in substantially normal relationship thereto and each of said outer legs extending from the outer side edge of a respective outermost upper base portion, said profiles defining cavities between adjacent legs, characterized in that at least two of the angled profiles are at least partially enclosed in each other in overlapping relationship such that the height of one of the inner legs is decreased by an amount corresponding to the height of the bases of each of the overlapping angled profiles.

2. A ski as claimed in claim 1, wherein the angled profiles are made of synthetic plastic.

3. A ski as claimed in claim 2, wherein the synthetic plastic is a fiber-reinforced synthetic plastic.

4. A ski as claimed in claim 1, wherein the angled profiles are made of aluminum.

5. A ski comprising:

a running surface extending in a longitudinal direction;

a top surface extending substantially parallel to the running surface;

a plurality of side surfaces extending between the running surface and the top surface;

a core defined by the running surface, the top surface and the side surfaces;

a plurality of angled profiles formed inside the core each angled profile comprising a plurality of longitudinally extending and laterally spaced bases extending substantially parallel to the running surface, said bases including upper base portions adjacent said top surfacae and lower base portions adjacent said running surface, said upper and lower base portions having longitudinally extending side edges a plurality of inner legs, and a plurality of outer legs adjacent the side surfaces, each of the inner legs extending from the longitudinal side edges of the respective upper and lower base portions in a direction substantially normal thereto and each of said outer legs extending from the outer side of a respective outermost base portion, said profiles defining cavities between adjacent legs, characterized in that at least three of the angled profiles are at least partially enclosed in each other in overlapping relationship, the at least three overlapping profiles including a central profile disposed at the center of the core and two outer profiles on either side of the central profile and adjacent the side surfaces, wherein the central profile defines an odd number of cavities and the height of the outer legs of the central profile is decreased by an amount corresponding to the height of the bases of the outer profiles and the height of the inner legs of the outer profiles is decreased by an amount corresponding to the height of the bases of the central profile at the locations where each of the inner legs of the outer profile contacts the vbases of the central profile.

6. A ski as claimed in claim 5, wherein the angled profiles are made of synthetic plastic.

7. A ski as claimed in claim 6, wherein the synthetic plastic is fiber-reinforced synthetic plastic.

8. A ski as claimed in claim 5, wherein the angled profiles are made of aluminum.

9. A ski as claimed in claim 5, wherein the central profile is substantially U-shaped in configuration and the height of the outer legs of the central profile is less than the height of the outer legs of each of the outer profiles.

10. A ski as claimed in claim 5, wherein the outer legs of each of the outer profiles closest to the side surfaces and the side surfaces are disposed at an angle with respect to a plane perpendicular to the running surface.

* * * * *

UNITED STATES PATENT AND TRADEMARK OFFICE

CERTIFICATE OF CORRECTION

PATENT NO. : 4,928,989

DATED : May 29, 1990

INVENTOR(S) : BERNHARD MAYR ET AL

It is certified that error appears in the above-identified patent and that said Letters Patent is hereby corrected as shown below:

Claim 1, column 4, line 65, "edges" should be followed by --,--.

Claim 5, column 5, line 26, "core" should be followed by --,-;

line 31, "surfacae" should be --surface--;

line 34, "edges" should be followed by --,--; and

Claim 5, column 6, line 20, "Vbases" should be --bases--.

Signed and Sealed this

Nineteenth Day of November, 1991

*Attest:*

HARRY F. MANBECK, JR.

*Attesting Officer*

*Commissioner of Patents and Trademarks*